US005629657A

United States Patent [19]

Bayorgeon et al.

[11] Patent Number: 5,629,657

[45] Date of Patent: May 13, 1997

[54] HIGH POWER WAVEGUIDE RF SEAL

[75] Inventors: Jeffrey T. Bayorgeon, Chino Hills; Robert Boubion, Brea; William L. Lange, Placentia; Stan W. Livingston, Fullerton; Ted C. Schmidt, La Palma, all of Calif.

[73] Assignee: Hughes Electronics, Los Angeles, Calif.

[21] Appl. No.: 640,327

[22] Filed: Apr. 30, 1996

[51] Int. Cl.[6] ..... H01P 1/04

[52] U.S. Cl. ..... 333/254

[58] Field of Search ..... 333/252, 254–257

[56] References Cited

U.S. PATENT DOCUMENTS

| | | | |
|---|---|---|---|
| 2,883,631 | 4/1959 | Blackadder et al. | 333/252 |
| 3,500,264 | 3/1970 | Floyd, Jr. | 333/254 |
| 4,932,673 | 6/1990 | Domnikov et al. | 333/254 X |
| 5,387,884 | 2/1995 | Porcello | 333/254 X |

FOREIGN PATENT DOCUMENTS

| | | | |
|---|---|---|---|
| 302773 | 7/1971 | U.S.S.R. | 333/254 |

*Primary Examiner*—Paul Gensler

*Attorney, Agent, or Firm*—Leonard A. Alkov; Wanda K. Denson-Low

[57] ABSTRACT

A waveguide seal (16) which provides reliable mechanical contact and which reduces the electrical breakdown in the area of a waveguide joint (10). The seal (16) includes a dovetailed groove (40) into which is inserted a helical coil (30). During assembly, flanges (18) of the interconnected waveguides (12, 14) are then compressed against the helical coils (30) on each side of the seal (16). The helical coil (30) is then partially compressed and provides reliable mechanical connection between the waveguides (12, 14) and the interposed seal (16). Further, a gap (58) in predefined areas between the seal (16) and the waveguide flanges (18) provides for significantly reduced electrical breakdown in the joint area, thereby providing a better electrical connection.

23 Claims, 2 Drawing Sheets

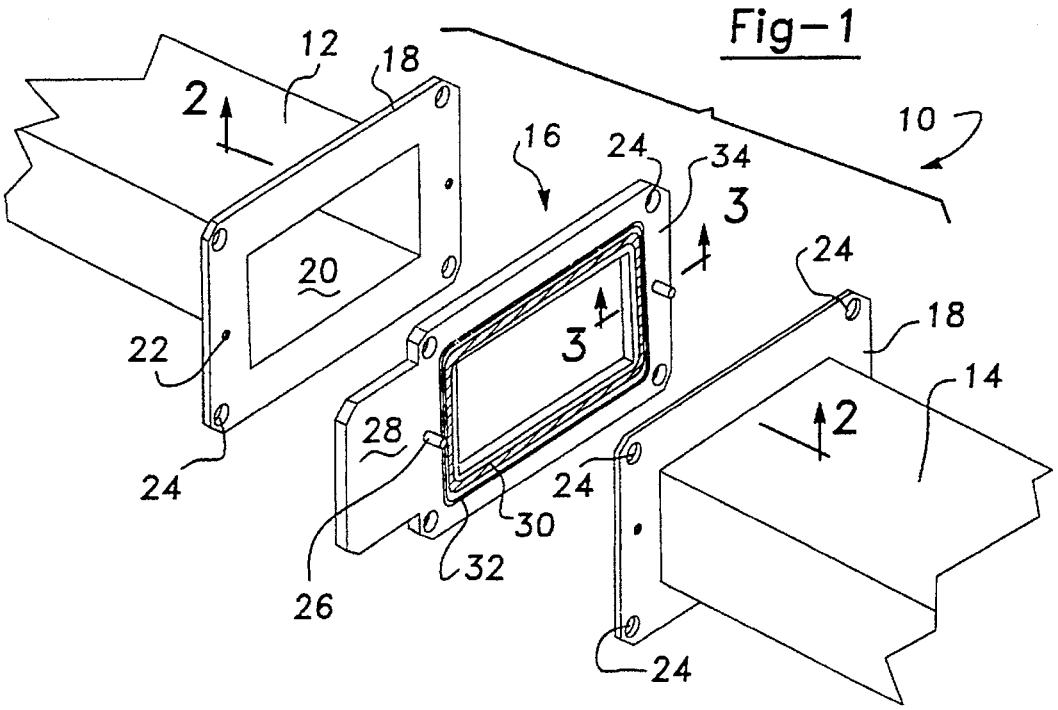
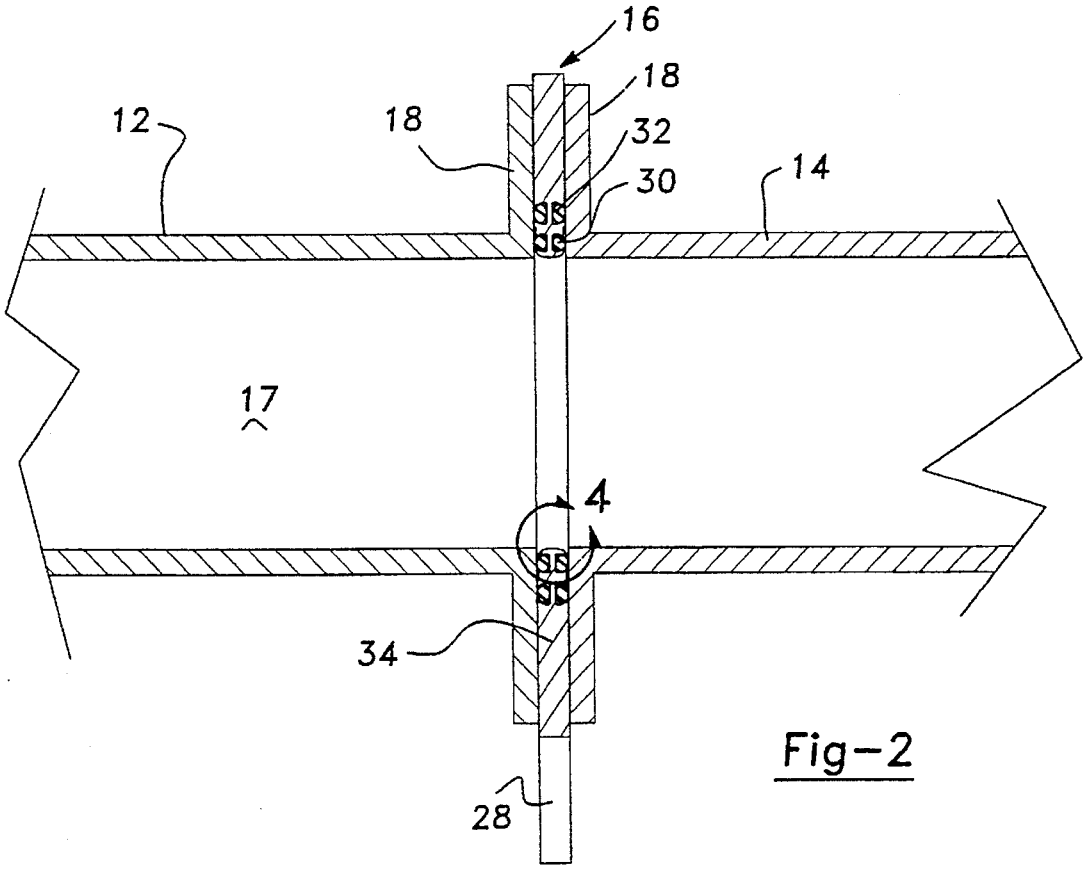
Fig-2

HIGH POWER WAVEGUIDE RF SEAL

BACKGROUND OF THE INVENTION

1. Field of the Invention

This invention related generally to waveguides and devices for interconnecting waveguides, and, more particularly, to a waveguide seal which provides reliable contact between the seal and the waveguides interconnected with the seal and which provides an insulating gap between flanges of the mating waveguides and the seal to better control the electric field.

2. Discussion

A waveguide may generally be described as a device which constrains or guides the propagation of electromagnetic waves along a path defined by the physical construction of the waveguide. The term waveguide usually refers to a metallic tube which confines and guides the propagation of electromagnetic waves in the hollow space along the lengthwise direction of the tube.

When waveguide systems are assembled, smaller lengths of waveguides are typically interconnected to provide a waveguide of sufficient length. Preferably, the interconnection of the waveguides provides a joint that will transmit high power across the joint with no electrical arcing and also provides an efficient radio frequency (RF) seal having little or no loss of signal strength.

Many factors impact the waveguide power handling ability, which impacts the waveguide capacity. For example, because sufficient mechanical contact between the waveguides is difficult to achieve, small gaps often appear between the mating waveguides. These small gaps reduce the electrical power handling capacity of the waveguide by causing large shunt electric (E) field breakdown.

More particularly, reliable contact between the mating flanges of the waveguides to eliminate gaps is most importantly achieved along the inside mating surfaces and corners to accommodate the skin depth of the current along the inner surface of the waveguide. If contact is not properly made, electric field strengths build and reduce the power handling capacity of the waveguides. Small imperfections in the waveguide surfaces prevent the inside corners from properly touching. In order to reduce the electric field, large gaps may be used to provide better power handling by the waveguide. However, the large gaps cause reflection in the flow of energy and enable energy to escape the waveguide.

From the foregoing, it becomes readily apparent that the interconnection of waveguides becomes an integral part of the proper operation and acceptable reliability of the waveguide system. There are various types of joints which are typically used to connect waveguides. A first joint, and generally the simplest, comprises a contact coupling mating two opposing flanges of the waveguide. Contact couplings do not generally consider power handling capabilities. Thus, a minor misalignment, a warped flange, or various surface imperfections result in arcing at the joint.

A second type of joint is characterized as a choke flange. Choke flanges insert large gaps between the mating waveguides in order to reduce arcing. The gap is preferably sized to reduce the electric field in order to minimize or eliminate breakdown. Typically, the gap extends as a shunt ½ wavelength transmission line circuit. The transmission line is short circuited in a cavity, thus lowering the reflection and electromagnetic interference (EMI) caused by the large gap or perturbation. However, choke circuits require relatively substantial volume to form such a distributed transmission line matching network.

A third type of joint may be formed by placing a gasket-type seal between the waveguide flanges. The seal typically provides reliable contact without gaps by compressing a conducting relief surface into each of the mating flanges. The joining surface may be milled with a transverse ridge, a diamond knurl, or diecast with some type of regular roughness. Although the gasket-type seal provides reliable electrical connection between the seal and the flanges, the gasket-type seal typically abrades the smooth flange surface while being compressed during assembly. The gasket-type seal results in a destructive union between the waveguides and is typically avoided in assemblies where the flange surfaces may be disassembled, then reassembled.

A flange joint can become an extremely important component in any waveguide system. Many microwave systems include flange joints. If arcing occurs in the flange joint, the joint may degrade or totally disrupt the overall performance of the system. Repairing flange joints typically includes disassembling the joint and replacing the waveguide flanges or seals. Such repair may be costly and difficult to effectuate in remotely located systems. More specifically, waveguide arcing may be a particularly important issue in high power microwave systems. Examples of radar systems using such flange joints include surface radar which uses high power waveguide flanges, airborne and spacecraft radar, satellite earth stations or up link, microwave relays, industrial ovens, and automobile radar as well.

Thus, it is an object of the present invention to join two waveguides at a joint while minimizing power handling capabilities at the joint.

It is a further object of the present invention to join two waveguides at a joint which transfers electromagnetic energy without electrical breakdown.

It is a further object of the present invention to provide a waveguide seal in which the gaps between the seal and the mating waveguide sections are arranged in order to control the electric field in proximity to the joint.

It is yet a further object of this invention to provide a waveguide seal in which the electric field in proximity to the seal is lower than the breakdown condition.

It is yet a further object of this invention to provide a seal for joining two waveguides at a joint, where the seal provides reliable mechanical contact between the two waveguides.

It is yet a further object of the present invention to join two waveguides using a seal which compensates for imperfections in the waveguides to provide reliable mechanical and electrical contact.

It is yet a further object of this invention to join two waveguides using an RF seal at a joint having high power capabilities, low loss, environmental sealing capabilities, and small volume.

It is yet a further object of this invention to provide a seal for joining two waveguides at a joint, where the seal interconnects two waveguides having relatively narrow flanges.

It is yet a further object of this invention to provide a seal for joining two waveguides at a joint, where the seal interconnections two waveguides using a minimum of fasteners.

SUMMARY OF THE INVENTION

This invention describes a waveguide seal for joining a pair of waveguides to form a joint. Each waveguide has a flange in proximity to the joint, and the waveguide seal includes a helical coil making contact between the waveguide seal and each waveguide flange.

Further, this invention describes a waveguide seal for joining a pair of waveguides to form a joint. Each waveguide has a flange in proximity to the joint, and the waveguide seal includes a frame member aligned with and interposed between each of the waveguide flanges. The frame member has a pair of grooves each facing a respective flange of the waveguide. A pair of helical coils is each partially inserted into a respective groove and retained in the groove, and each of the pair of helical coils contacts a respective flange.

Additional objects, features and advantages of the present invention will become apparent from the following description and the appended claims, taken in connection with the accompanying drawings.

BRIEF DESCRIPTION OF THE DRAWINGS

FIG. 1 is an exploded, perspective view of a waveguide joint for interconnecting two waveguides arranged in accordance with the principles of the present invention;

FIG. 2 is a cross-sectional view taken along the line 2—2 of the waveguide assembly shown in FIG. 1;

DETAILED DESCRIPTION OF A PREFERRED EMBODIMENT

Figure 3:
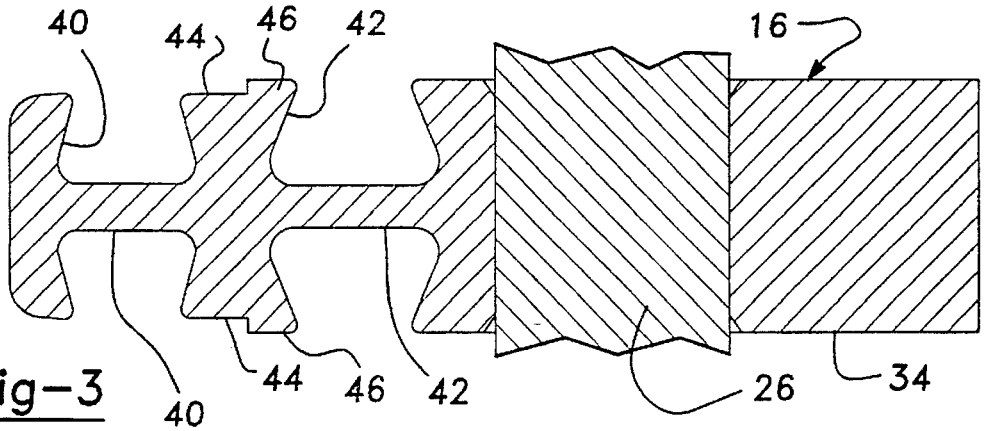
FIG. 3 is a partial, cross-sectional view of the waveguide seal taken along line 3—3 of the waveguide seal of FIG. 1.

Referring to FIGS. 1 and 2, a waveguide joint 10 is shown. The joint 10 includes a first waveguide 12 and a second waveguide 14 which interconnect via a seal 16. The interconnection of waveguides 12 and 14 via seal 16 defines a waveguide path 20 in which electromagnetic waves may propagate. The seal 16 provides a mechanical and electrical interconnection between the waveguides 12 and 14 and also provides an environmental seal for the interior of waveguides 12 and 14.

Waveguides 12 and 14 each include a flange 18 at the interconnecting ends. The flanges 18 include bolt holes 24 and alignment holes 22 which cooperate with bolt holes 24 and alignment pins 26 of the seal 16. The seal 16 also includes a handle 28 which facilitates handling of the seal 16 and also facilitates assembly and disassembly of the waveguide joint 10.

Figure 4:
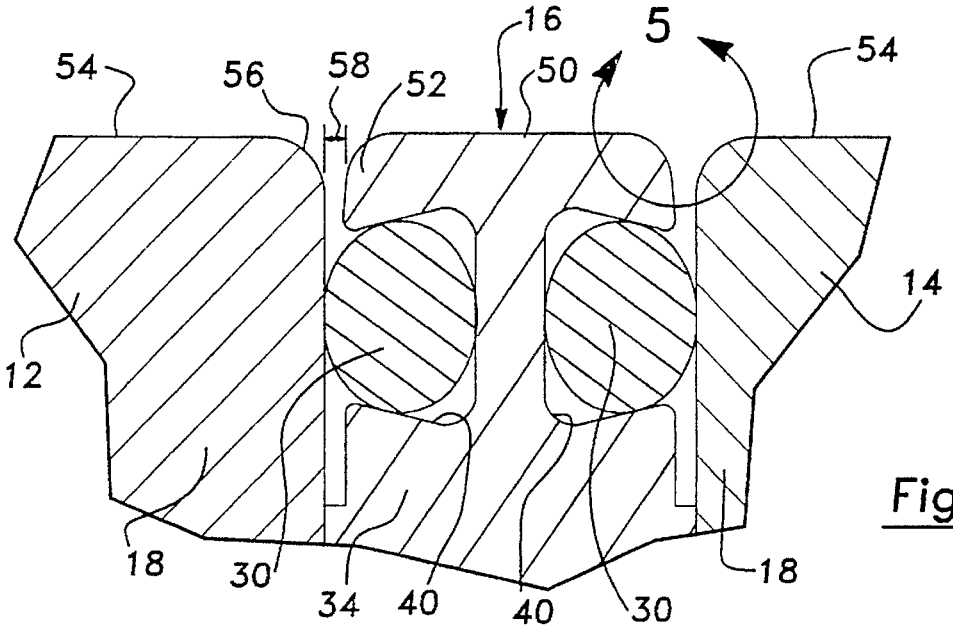
FIG. 4 is an expanded cross-sectional view of the area defined by the line 4—4 of FIG. 2.

The seal 16 also includes a frame 34 having on each side a helical coil 30 (shown on the side facing waveguide 14) which is inserted into a dovetailed groove on the frame 34, to be described further herein with respect to FIGS. 3 and 4. The helical coil 30 is a generally circularly wound metallic element, such as beryllium copper with tin plating. An example of the helical coil may be found to reference to part number ESS-04 manufactured by Spira. A similar helical coil 30 is positioned on the other side of the frame 34.

Exterior to the helical coil 30 on the frame 34, an O-ring 32 is inserted into a second dovetailed groove of the frame 34 (shown on the side facing waveguide 14). The O-ring 32 is a rubber based material, such as part number 2-033-V747-75 manufactured by Parker. O-ring 32 provides an environmental seal for the waveguide joint 10. A similar O-ring 32 is positioned on the other side of the frame 34. Typically, the interior of the waveguide is pressurized with dry air, nitrogen, or freon nitrous oxide gas at a pressure of 0–30 pounds per square inch (PSI) in order to provide an inert atmosphere to reduce arcing and to limit corrosion.

In operation, the seal 16 is preassembled to include the helical coils 30 inserted into their respective grooves on each side of the frame 34 and with the O-rings 32 inserted into their respective grooves on each side of the frame 34. The seal 16 is installed between the flanges 18 of waveguides 12 and 14. The joint 10 is assembled by aligning the alignment holes 22 of the flanges 18 with the alignment pins 26 of the seal 16 in order to properly align the waveguides 12 and 14 with each other and with the seal 16.

The joint 10 is bolted together by bolts (not shown) inserted through bolt holes 24 and secured with a nut (not shown) threaded onto the bolt. The nut/bolt assembly is then tightened to provide compression between the seal and the respective waveguides 12 and 14. As compression occurs, the helical coils 30 are compressed into the dovetail grooves approximately 0.005 to 0.010 inches. Upon compression, the helical coils 30 maintain contact between both the waveguide seal 16 and the waveguide flanges 18 at defined contact points. This provides reliable mechanical contact between the waveguides 12 and 14 and the seal 16, thereby minimizing undesired gaps in the joint 10.

Preferably, the assembly produces substantially flush and continuous interior surfaces so that the joint 10 formed by the interconnection provides minimal electrical or surface discontinuities. This substantially reduces the potential for arcing and minimizes reflection in the flow of energy. It will be understood by one skilled in the art that other fastening methods may be employed. Further, the assembly described above requires a minimum of fasteners to assemble the joint 10. Further yet, the seal 16 is preferably formed to be thin to minimize separation between the waveguide flanges 18.

FIG. 3 is an expanded cross-sectional view taken along the line 3—3 of FIG. 1. The expanded cross-sectional view shows the frame 34 and one alignment pin 26. FIG. 3 also shows the arrangement for the dovetailed grooves 40 which receive the helical coil 30 (of FIGS. 1 and 2). Also shown are the dovetailed grooves 42 which receive the O-ring 32. In the area of the dovetailed grooves 40 for helical coil 30, the side surfaces 44 of the frame 34 are slightly recessed from the side surfaces 46 of the frame 34 of seal 16. This enables a reliable and controlled mechanical contact between the helical coil 30 and the flanges 18. In particular, side surfaces 44 intentionally provide an insulating gap to minimize the possibility of electrical breakdown.

FIG. 4 is an expanded view about the line 4—4 of FIG. 2 and demonstrates a preferred gap spacing between the seal 16 and the respective flanges 18 of the waveguides 12 and 14. The helical coils 30 are shown inserted into the dovetailed grooves 40. Seal 16 includes an interior edge 50 along the waveguide path 20. The interior edge 50 has broken corners 52 which may be radiused, arcuate, or otherwise broken. Preferably, the corners 52 have a radius of 0.015 inches. One skilled in the art will recognize that the radius may vary in accordance with the particular application. Waveguides 12 and 14 include interior surfaces 54 also having corners 56 which are also, radiused, arcuate, or otherwise broken. The corners 56 preferably have a radius of 0.015 inches. By breaking the corners 52 and 56, the gap 58 between the seal 16 and each of the respective waveguides 12 and 14 may be varied in order to minimize electrical arcing potential. The gap 58 between the waveguides 12 and 14 and the seal 16 is preferably designed to minimize the electric lines of force, and may be varied in accordance with the particular application of the waveguide.

Figure 5:
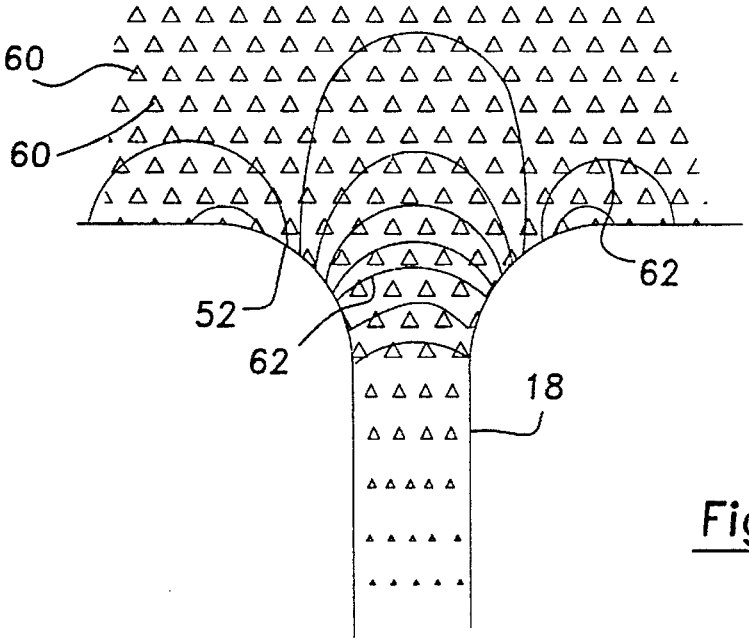
FIG. 5 is an expanded view of the corner area of the seal and waveguide interface of the area defined by the line 5—5 of FIG. 4.

FIG. 5 depicts an electrical field diagram of an expanded view of the gap 58 along line 5—5 of FIG. 4. FIG. 5 shows electrical field vector symbols 60 and equal potential contour lines 62. The size of the field vector symbols 60 varies in accordance with the strength of the field. In areas with close proximity of opposing potentially charged surfaces, reduced electric fields decrease the probability of electrical breakdown. Thus, at the corners 52 of the gap 58, the electric field may be relatively high and in close proximity. The electric field must be controlled to reduce the probability of electrical breakdown without disturbing the flow of energy across the gap. The electrical field vectors decrease in value further into the gap, thus reducing the probability of electrical breakdown down inside the gap 58. The shape of the surface junction, such as smoothing the corners 52 and the optimized gap width provided by the present invention reduces the probability of electrical breakdown while allowing electrical signals to couple across the gap.

From the foregoing, it can be seen that the present invention provides a novel method and apparatus for interconnecting waveguides and reducing the electrical breakdown in the areas of the interconnection. This improved system results from the use of a helical coil inserted into a dovetailed groove on each side of the waveguide seal. Mating flanges of the interconnected waveguides are then compressed against the seal providing a mechanical interconnection having improved reliability. Moreover, the interior surfaces of the seal and the waveguides in the flange areas may be broken or otherwise radiused in the corners in order to further reduce the potential for electrical breakdown in the joint area.

Although the invention has been described with particular reference to certain preferred embodiments thereof, variations and modifications can be effected within the spirit and scope of the following claims.

What is claimed is:

1. A waveguide seal for joining a pair of waveguides to form a joint, each waveguide having a flange in proximity to the joint, the waveguide seal including a helical coil making contact between the waveguide seal and each waveguide flange.

2. The waveguide seal of claim 1 further comprising a groove formed in the seal and facing each flange, the helical coil being received by the groove and partially recessed therein.

3. The waveguide seal of claim 1 wherein the helical coil further comprises a pair of helical coils each arranged to contact the seal and a respective flange.

4. The waveguide seal of claim 3 wherein the seal is recessed in proximity to the grooves where the helical coil contacts each respective flange.

5. The waveguide seal of claim 3 wherein the groove further comprises a pair of grooves arranged on the seal each arranged to contact the seal and a respective flange.

6. The waveguide seal of claim 1 further comprising an O-ring groove arranged exteriorly to the helical coil and an O-ring received by the O-ring groove, the O-ring arranged to contact the seal and a respective flange, whereby when the seal and waveguides are assembled, the O-ring provides an environmental seal.

7. The waveguide seal of claim 1 wherein the seal includes an interior edge along a waveguide path and cooperating with respective sides of the seal to form a pair of corners, where the corners are formed to vary the electrical field in proximity thereto.

8. The waveguide seal of claim 7 wherein the flanges cooperate with their respective waveguides to form respective corners, and each corner is formed to control the electrical field in proximity thereto.

9. The waveguide seal of claim 8 wherein each corner of the seal is associated with a corner of a waveguide, and each pair of corners are formed to cooperate and control the electrical field in proximity thereto.

10. A waveguide seal for joining a pair of waveguides to form a joint, each waveguide having a flange in proximity to the joint, the waveguide seal comprising:

a frame member aligned with and interposed between each of the waveguide flanges, the frame member having a pair of grooves each facing a respective flange; and a pair of helical coils each partially inserted into a respective groove and maintained therein, each of the pair of helical coils contacting a respective flange.

11. The waveguide seal of claim 10 wherein the grooves are dovetailed to facilitate insertion of the helical coils therein, and the helical coil is compressed when the waveguide seal and waveguides are assembled.

12. The waveguide seal of claim 10, further comprising:

a second pair of grooves, each facing a respective flange and being arranged exteriorly to the first pair of grooves; and a pair of O-rings, each partially inserted into a respective groove and maintained therein, each O-ring contacting a respective flange, wherein when the frame and waveguides are connected, the O-rings form an environmental seal.

13. The waveguide seal of claim 10 further comprising a handle arranged exteriorly to the frame to facilitate handling of the waveguide seal.

14. The waveguide seal of claim 10 further comprising alignment holes arranged on each flange, the alignment holes receiving alignment pins arranged on the frame of the waveguide seal.

15. The waveguide seal of claim 10 wherein the frame includes an interior edge facing a waveguide path formed by the waveguides and seal, the interior edge being arranged to vary the electrical field in proximity to the joint.

16. The waveguide seal of claim 10 wherein the waveguide flanges form a corner with the waveguide, and the corner is arranged to vary the electrical field in proximity to the joint.

17. The waveguide seal of claim 10 wherein the frame includes an interior edge facing a waveguide path formed by the waveguides and seal, the interior edge having two corners, the corners being broken to vary the electrical field in proximity to the joint.

18. The waveguide seal of claim 17 wherein the waveguide flanges form a corner with the waveguide, and the corner is arranged to vary the electrical field in proximity to the joint.

19. The waveguide seal of claim 10 wherein the frame is partially recessed in proximity to each groove.

20. A method for reducing the electrical breakdown in proximity to a waveguide joint, where a pair of waveguides form the joint, and each waveguide has a flange in proximity to the joint, the method comprising the step of:

providing a waveguide seal interposed between the flanges, where the seal has a pair of grooves each facing a respective flange;

partially inserting a helical coil in each groove, where the helical coil is maintained within the groove and each helical coil contacts a respective flange; and forming a gap between each flange and the seal by breaking opposing corners of the seal and each respective flange, the gap reducing the electrical field between the seal and the respective flanges.

21. The method of claim 20 further comprising dovetailing the grooves to facilitate insertion of the helical coils therein, where the helical coil is compressed when the seal and waveguides are assembled.

22. The method of claim 20, further comprising:

providing a second pair of grooves, each facing a respective flange and being arranged exteriorly to the first pair of grooves; and partially inserting a pair of O-rings into a respective groove so that the O-rings are maintained therein, each O-ring contacting a respective flange, wherein when the frame and waveguides are connected, the O-rings form an environmental seal.

23. The method of claim 20 further comprising the step of forming an interior edge of the seal facing a waveguide path in order to vary the electrical field in proximity to the joint.

* * * * *